US008779992B2

(12) United States Patent
Wang et al.

(10) Patent No.: US 8,779,992 B2
(45) Date of Patent: Jul. 15, 2014

(54) WIRELESS COMMUNICATION APPARATUS AND PLANAR ANTENNA THEREOF

(75) Inventors: Sy-Been Wang, Hsinchu County (TW); Kuo-Chang Lo, Miaoli County (TW); Shih-Chieh Cheng, Tainan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 263 days.

(21) Appl. No.: 13/175,821

(22) Filed: Jul. 1, 2011

(65) Prior Publication Data

US 2012/0001820 A1 Jan. 5, 2012

(30) Foreign Application Priority Data

Jul. 2, 2010 (TW) ..... 99121911 A

(51) Int. Cl.
*H01Q 1/24* (2006.01)

(52) U.S. Cl.
USPC ..... 343/702; 343/700 MS; 343/846

(58) Field of Classification Search
USPC ..... 343/845, 846
See application file for complete search history.

(56) References Cited

U.S. PATENT DOCUMENTS

| | | | | |
|---|---|---|---|---|
| 7,345,647 | B1 | 3/2008 | Rodenbeck | |
| 2003/0080904 | A1 * | 5/2003 | Chen | 343/700 MS |
| 2006/0170598 | A1 * | 8/2006 | Kwan et al. | 343/702 |
| 2008/0106471 | A1 * | 5/2008 | Yeh | 343/700 MS |
| 2010/0164811 | A1 * | 7/2010 | Cheng et al. | 343/700 MS |
| 2011/0080324 | A1 | 4/2011 | Chang | |

FOREIGN PATENT DOCUMENTS

| | | |
|---|---|---|
| CN | 101083352 A | 12/2007 |
| TW | M3663092 | 8/2009 |

* cited by examiner

*Primary Examiner* — Michael C Wimer
*Assistant Examiner* — Michael Bouizza
(74) *Attorney, Agent, or Firm* — Rabin & Berdo, P.C.

(57) ABSTRACT

A wireless communication apparatus and a planar antenna thereof are provided. The wireless communication apparatus comprises a connecting port, a printed circuit board, and a planar antenna. The printed circuit board is connected to the connecting port, and the planar antenna is formed on the printed circuit board. The planar antenna comprises a radiation portion, a shorting portion, and a feeding portion. The feeding portion is connected to the radiation portion and the shorting portion, and the radiation portion and the shorting portion are in a bent shape so that the radiation portion, the shorting portion and the feeding portion are distributed in a rectangular region.

13 Claims, 6 Drawing Sheets

WIRELESS COMMUNICATION APPARATUS AND PLANAR ANTENNA THEREOF

This application claims the benefit of Taiwan application Ser. No. 99121911, filed Jul. 2, 2010, the subject matter of which is incorporated herein by reference.

BACKGROUND OF THE INVENTION

1. Field of the Invention

The invention relates in general to a wireless communication apparatus and a planar antenna thereof, and more particularly to a down-sized wireless communication apparatus and a planar antenna thereof.

2. Description of the Related Art

Along with the advance in the technology of computer and wireless communication, wireless area network (WLAN) has been widely used people's everyday life. Currently, many of the electronic devices can be connected to WLAN via a universal serial bus (USB) wireless network card.

As the design of the electronic devices is directed towards lightweight, slimness and compactness, the area of the USB wireless network card is restricted to be as small as a USB flash drive. Therefore, how to reduce space occupied by the antenna on a printed circuit board has become a prominent task for the industries.

SUMMARY OF THE INVENTION

The invention is directed to a wireless communication apparatus and a planar antenna thereof, at least having the following advantages:

Firstly, area occupied by the planar antenna on a printed circuit board is reduced so as to meet the current requirement of size reduction of electronic devices;

Secondly, the difficulty in the circuit layout of a printed circuit board is reduced; and Thirdly, the planar antenna can be matched to system requirements through simple adjustments.

According to an aspect of the invention, a planar antenna is provided. The planar antenna comprises a radiation portion, a shorting portion, and a feeding portion. The feeding portion is connected to the radiation portion and the shorting portion, and the radiation portion and the shorting portion are in a bent shape so that the radiation portion, the shorting portion and the feeding portion are distributed in a rectangular region.

According to another aspect of the invention, a wireless communication apparatus is provided. The wireless communication apparatus comprises a connecting port, a printed circuit board, and a planar antenna. The printed circuit board is connected to the connecting port, and the planar antenna is formed on the printed circuit board. The planar antenna comprises a radiation portion, a shorting portion, and a feeding portion. The feeding portion is connected to the radiation portion and the shorting portion, and the radiation portion and the shorting portion are in a bent shape so that the radiation portion, the shorting portion and the feeding portion are distributed in a rectangular region.

The rectangular region of the invention further comprises a first sub rectangular region and a second sub rectangular region not overlapping each other. The feeding portion is located at the boundary between the first sub rectangular region and the second sub rectangular region. The shorting portion is continuously bent so as to be distributed in the first sub rectangular region. The radiation portion is continuously bent so as to be distributed in the second sub rectangular region.

The feeding portion of the invention further comprises a first feeding end and a second feeding end corresponding to the first feeding end. The radiation portion further comprises a first radiation end and a second radiation end corresponding to the first radiation end. The continuous bending of the radiation portion is located between the first radiation end and the second radiation end. The shorting portion further comprises a first shorting end and a second shorting end corresponding to the first shorting end. The continuous bending of the shorting portion is located between the first shorting end and the second shorting end. The first feeding end is connected to the feeding signal. The second feeding end is connected to the first radiation end and the second shorting end. The first shorting end is grounded.

Preferably, the largest vertical distance between the continuous bending of the radiation portion and the feeding portion is a first interval, and the shortest vertical distance between the continuous bending of the radiation portion and the feeding portion is a second interval. As used herein, vertical may mean perpendicularly oriented. For example, the first interval is the shortest distance that is measured along a straight line that is perpendicular to both the continuous bending of the radiation portion and the feeding portion. The largest vertical distance between the continuous bending of the shorting portion and the feeding portion is a third interval. The ground end comprises a first lateral side and a second lateral side, wherein the first lateral side and the first shorting end are orthogonally connected, and the second lateral side and the first feeding end are adjacent at to each other at an orthogonal angle. The vertical distance between the second lateral side and the first bending of the continuous bending extended from the first radiation end is equal to a fourth interval. The vertical distance between the first shorting end and the second lateral side is equal to a fifth interval. The fourth interval is larger than or equal to the fifth interval. The second interval, the fourth interval and the fifth interval are determined by a ratio of the third interval to the first interval.

Preferably, the radiation portion of the invention further comprises a first bending and a second bending. The first bending is the bending of the radiation portion farthest away from the feeding portion, and the vertical distance from the first bending to the feeding portion is a first interval. The second bending is the bending of the radiation portion nearest to the feeding portion, and the vertical distance from the second bending to the feeding portion is a second interval. The first shorting end is connected to a grounding surface, and the second shorting end is connected to one end of the feeding portion. The ground end is a grounding surface, which comprises a first lateral side connected to the shorting portion and a second lateral side adjacent to the radiation portion, wherein the first lateral side and the second lateral side are orthogonally connected. The shorting portion is continuously bent to one end of the feeding portion from the first lateral side in a direction moving away from the first lateral side. The radiation portion is continuously bent from one end of the feeding portion in a direction approaching the second lateral side. The vertical distance from the first lateral side to the feeding portion is a third interval. The vertical distance from the first bending to the second lateral side is equal to a fourth interval. The vertical distance from the first shorting end to the second lateral side is equal to a fifth interval. The fourth interval is larger than or equal to the fifth interval. The second interval, the fourth interval and the fifth interval are determined by the ratio of the third interval to the first interval.

The above and other aspects of the invention will become better understood with regard to the following detailed description of the preferred but non-limiting embodiment(s). The following description is made with reference to the accompanying drawings.

DETAILED DESCRIPTION OF THE INVENTION

As the design of the electronic devices is directed towards lightweight, slimness and compactness, how to provide a small-sized antenna satisfying the above requirements has become a prominent challenge in the design of antenna. Therefore, a wireless communication apparatus and a planar antenna thereof are provided in the embodiments below. The wireless communication apparatus comprises a connecting port, a printed circuit board, and a planar antenna. The printed circuit board is connected to the connecting port, and the planar antenna is formed on the printed circuit board. The planar antenna comprises a radiation portion, a shorting portion, and a feeding portion. The feeding portion is connected to the radiation portion and the shorting portion, and the radiation portion and the shorting portion are in a bent shape so that the radiation portion, the shorting portion and the feeding portion are distributed in a rectangular region.

FIRST EMBODIMENT

Figure 1:
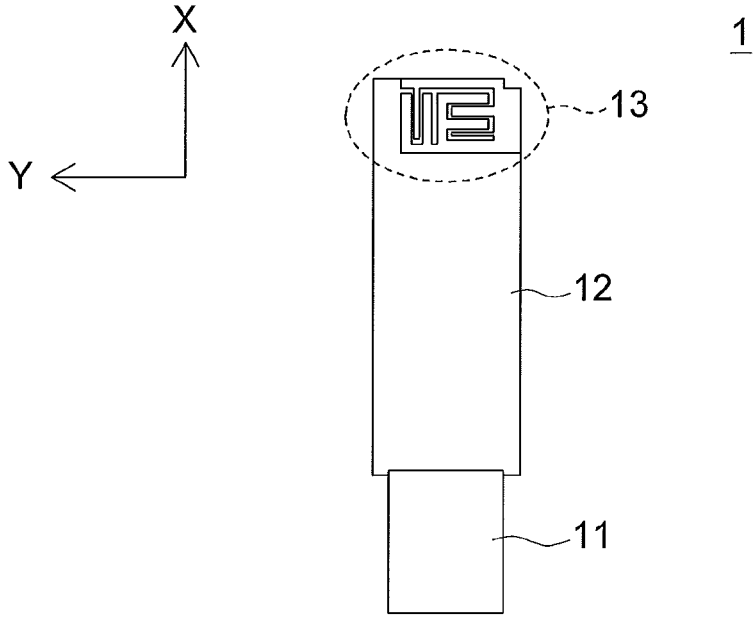
FIG. 1 shows a wireless communication apparatus according to an exemplary embodiment of the invention.

Referring to FIG. 1, a wireless communication apparatus according to an exemplary embodiment of the invention is shown. The wireless communication apparatus 1, realized by such as a wireless network card, comprises a connecting port 11, a printed circuit board 12 and a planar antenna 13. The printed circuit board 12 is connected to the connecting port 11, and the planar antenna 13 is a printed antenna formed on the printed circuit board 23. The operating frequency of the planar antenna 13 such as ranges between 2.4 GHz~2.5 GHz, and the thickness of the printed circuit board 12 is such as 1.6 mm.

Figure 2:
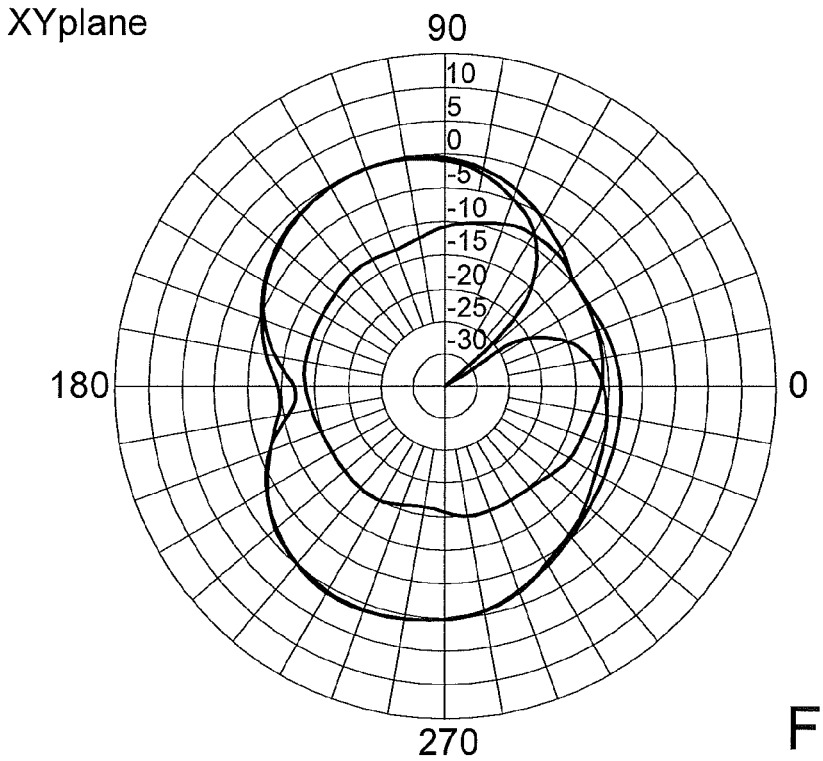
FIG. 2 shows a radiation field pattern of a planar antenna on the XY plane.
Figure 3:
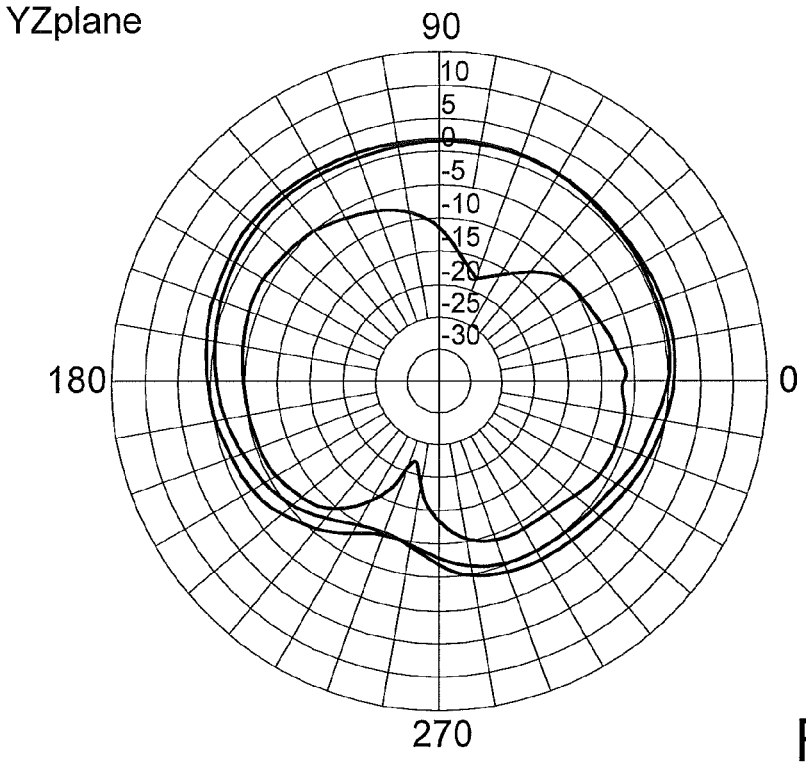
FIG. 3 shows a radiation field pattern of a planar antenna on the YZ plane.
Figure 4:
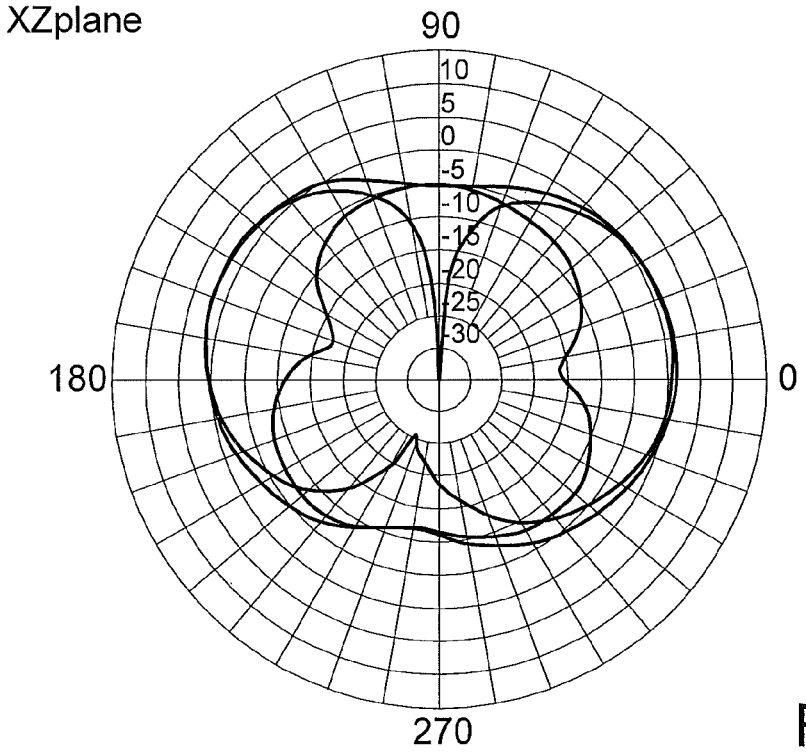
FIG. 4 shows a radiation field pattern of a planar antenna on the XZ plane.

Referring to FIG. 2, FIG. 3 and FIG. 4. FIG. 2 shows a radiation field pattern of a planar antenna on the XY plane. FIG. 3 shows a radiation field pattern of a planar antenna on the YZ plane. FIG. 4 shows a radiation field pattern of a planar antenna on the XZ plane. As indicated in FIG. 2, the peak gain of the radiation field pattern of the planar antenna 13 on the XY plane is 0.81 dBi, and the average gain is −3.12 dBi. As indicated in FIG. 3, the peak gain of the radiation field pattern of the planar antenna 13 on the YZ plane is 1.85 dBi, and the average gain is −0.36 dBi. As indicated in FIG. 4, the peak gain of the radiation field pattern of the planar antenna 13 on the XZ plane is 1.30 dBi, and the average gain is −1.91 dBi.

Figure 5:
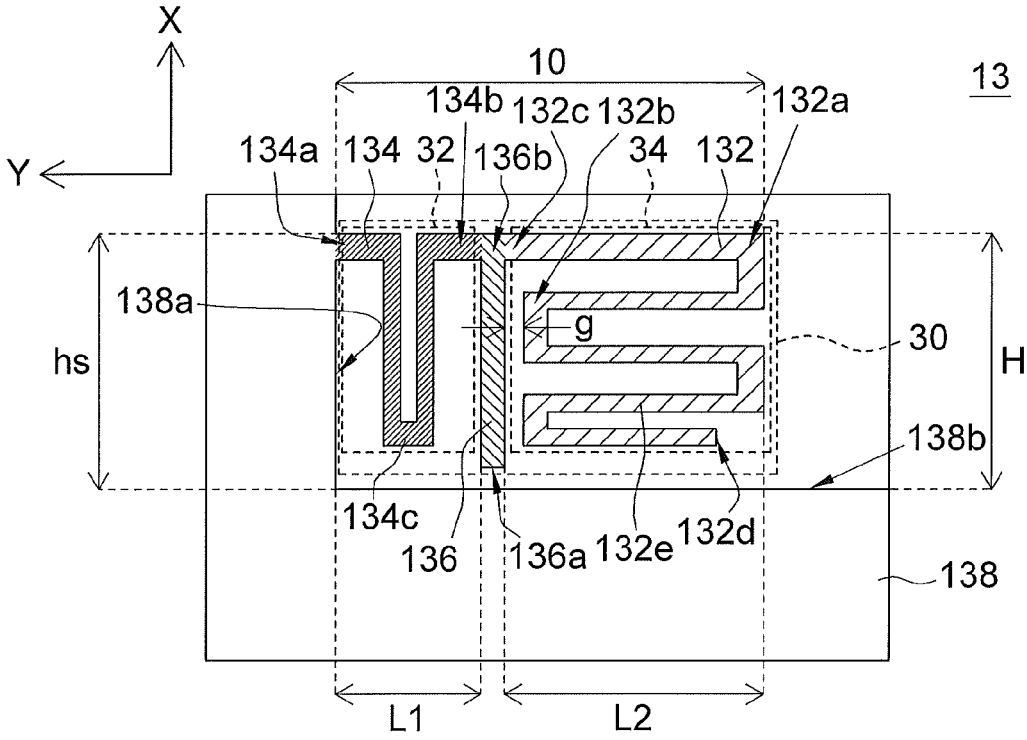
FIG. 5 shows a planar antenna according to a first embodiment of the invention.

Referring to FIG. 5, a planar antenna according to a first embodiment of the invention is shown. The planar antenna 13 comprises a radiation portion 132, a shorting portion 134 and a feeding portion 136, wherein the radiation portion 132, the shorting portion 134 and the feeding portion 136 are formed on the printed circuit board 23 illustrated in FIG. 1. The shorting portion 134 is connected to the radiation portion 132 and the feeding portion 136, wherein the radiation portion 132 and the shorting portion 134 are in a bent shape so that the radiation portion 132, the shorting portion 134 and the feeding portion 136 are distributed in rectangular region 30. The rectangular region 30, such as smaller than 10 mm×8 mm, comprises a first sub rectangular region 32 and a second sub rectangular region 34 not overlapping with each other. The shorting portion 134 is continuously bent so as to be distributed in the first sub rectangular region 32. The radiation portion 132 is continuously bent so as to be distributed in the second sub rectangular region 34. The feeding portion 136 is located at the boundary between the first sub rectangular region 32 and the second sub rectangular region 34. The area occupied by the planar antenna 13 on the printed circuit board 12 is smaller than area occupied by the planar antenna of a conventional wireless communication apparatus, not only contributing to the miniaturization of the wireless communication apparatus but also reducing the difficulty of circuit layout on the printed circuit board.

The radiation portion 132 comprises a first radiation end 132*c*, a second radiation end 132*d* and a first continuous bending 132*e*. The first radiation end 132*c* corresponds to the second radiation end 132*d*, and the first continuous bending 132*e* is located between the first radiation end 132*c* and the second radiation end 132*d*. The first continuous bending 132*e* further comprises a first bending 132*a* and a second bending 132*b*. The first bending 132*a* is the bending of the first continuous bending 132*e* farthest away from the feeding portion 136 in terms of vertical distance. That is, the largest vertical distance between the first continuous bending 132*e* and the feeding portion 136 is a first interval L2. The second bending 132*b* is the bending of the first continuous bending 132*e* nearest to the feeding portion 136 in terms of vertical distance. That is, the shortest vertical distance between the first continuous bending 132*e* and the feeding portion 136 is a second interval g.

The shorting portion 134 comprises a first shorting end 134*a*, a second shorting end 134*b* and a second continuous bending 134*c*. The first shorting end 134*a* corresponds to the second shorting end 134*b*, and the second continuous bending 134*c* is located between the first shorting end 134*a* and the second shorting end 134*b*. The first shorting end 134*a* is connected to the grounding surface 138.

The feeding portion 136 comprises a first feeding end 136*a* and a second feeding end 136*b* corresponding to the first feeding end 136*a*. The first feeding end 136*a* is connected to the feeding signal, and the second feeding end 136*b* is connected to the first radiation end 132*c* and the second shorting end 134*b*, so that the radiation portion 132, the shorting portion 134 and the feeding portion 136 are distributed in a rectangular region 30.

The grounding surface 138 comprises a first lateral side 138*a* and a second lateral side 138*b*. The first lateral side 138*a* and the first shorting end 134*a* are orthogonally connected, while the first lateral side 138*a* and the second lateral side 138*b* are adjacent at to each other at an orthogonal angle. The shorting portion 134 is continuously bent to the second feeding end 136*b* from the first lateral side 138*a* in a direction moving away from the first lateral side 138*a*, and the radiation portion 132 is continuously bent from the second feeding end 136*b* in a direction approaching the second lateral side 138.

The vertical distance from the first lateral side 138*a* to the feeding portion 136 is a third interval L1. That is, the largest vertical distance between the second continuous bending 134*c* and the feeding portion 136 is a third interval L1. The first bending 132*a* is the first bending extended from the first continuous bending 132*e*, and the vertical distance from the first bending 132*a* to the second lateral side 138*b* is the fourth interval H. The vertical distance from the first shorting end 134*a* to the second lateral side 138*b* is a fifth interval hs. The second interval g, the fourth interval H and the fifth interval hs are determined by the ratio of the third interval L1 to the first interval L2. The fourth interval H is such as larger than or equal to the fifth interval hs. In FIG. 2, the fourth interval H is equal to the fifth interval hs.

Figure 6:
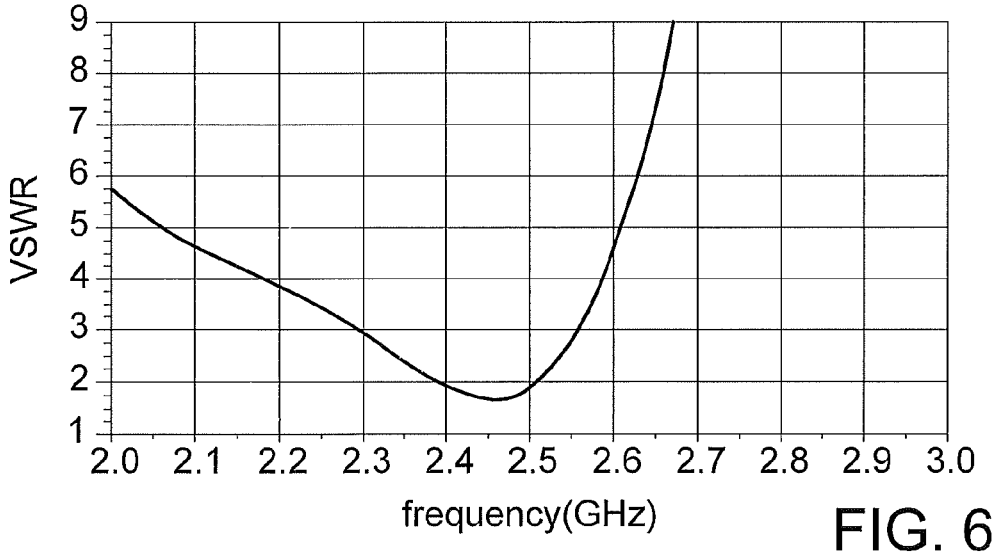
FIG. 6, FIG. 7 and FIG. 8 respectively show the VSWR measurement chart of the planar antenna 13 with different dimension designs.
Figure 7:
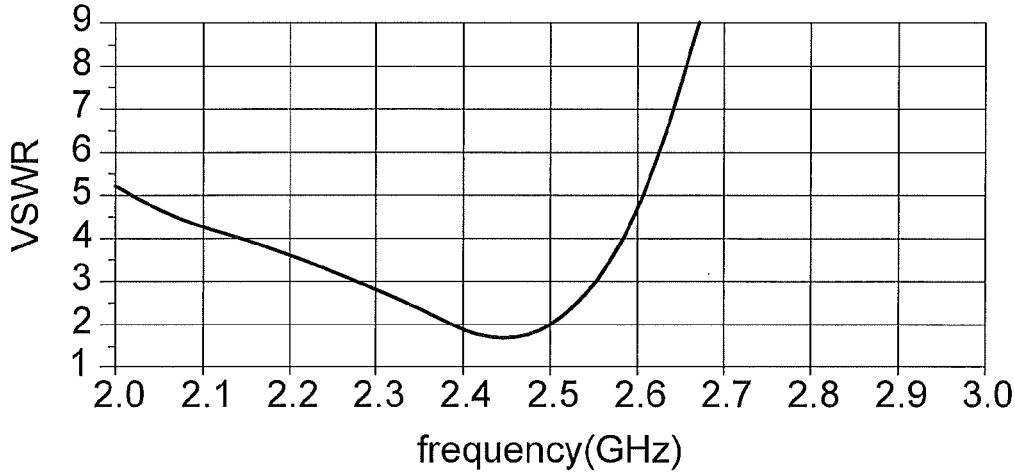
Figure 8:
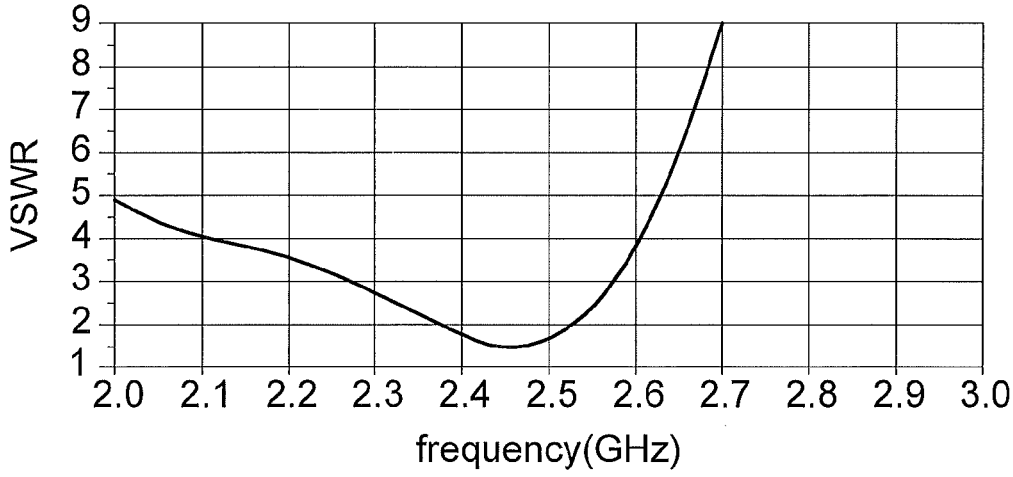

Referring to FIG. 6, FIG. 7 and FIG. 8, VSWR measurement charts of the planar antenna 13 with different dimension designs are respectively shown. FIG. 6 is a measurement chart of voltage standing wave ratio (VSWR) when the third interval L1=3.4, the first interval L2=6, the fourth interval H=7, the second interval g=1 and the fifth interval hs=7. FIG. 7 is a measurement chart of voltage standing wave ratio (VSWR) when the third interval L1=4.4, the first interval L2=6, the fourth interval H=7, the second interval g=1 and the fifth interval hs=7. FIG. 8 is a measurement chart of voltage standing wave ratio (VSWR) when the third interval L1=3.4, the first interval L2=7, the fourth interval H=6, the second interval g=1 and the fifth interval hs=6.

SECOND EMBODIMENT

Figure 9:
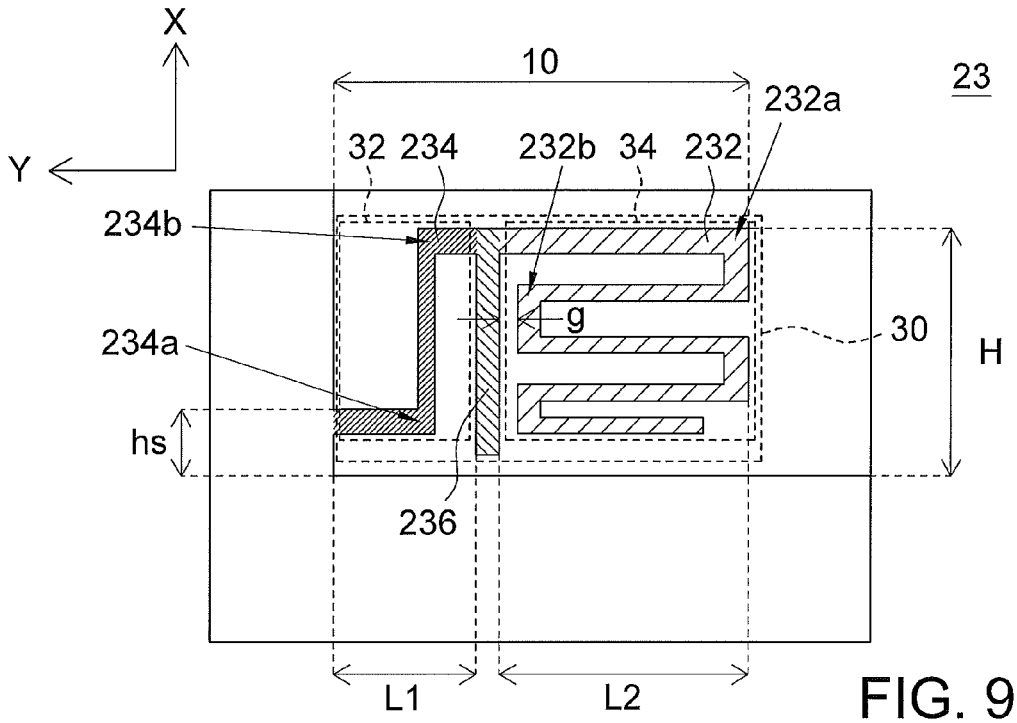
FIG. 9 shows a planar antenna according to a second embodiment of the invention.

Referring to FIG. 9, a planar antenna according to a second embodiment of the invention is shown. The second embodiment is different from the first embodiment in that the shape of the shorting portion 234 of the planar antenna 23 is different from that of the shorting portion 134 of the planar antenna 13, and that the fourth interval H is different from the fifth interval hs.

Figure 10:
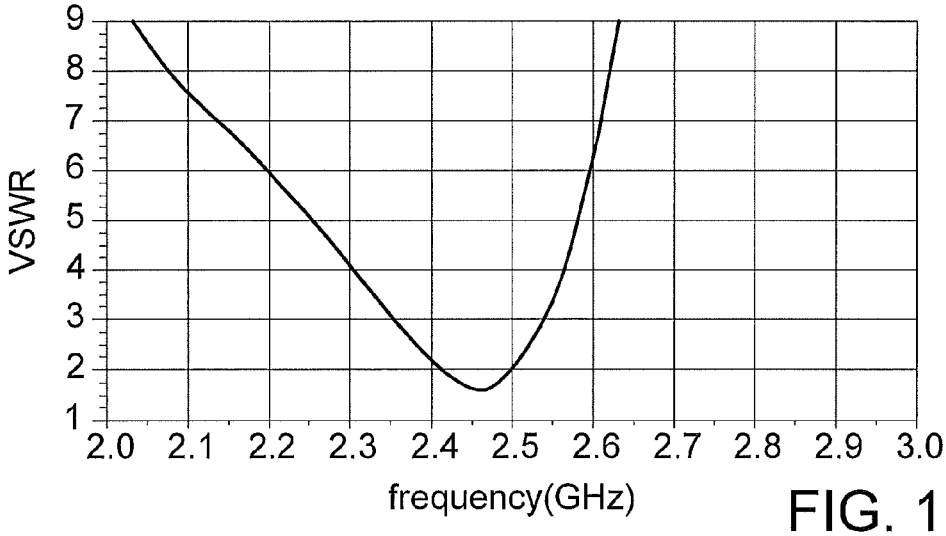
FIG. 10, FIG. 11 and FIG. 12 respectively show the VSWR measurement chart of the planar antenna 23 with different dimension designs.
Figure 11:
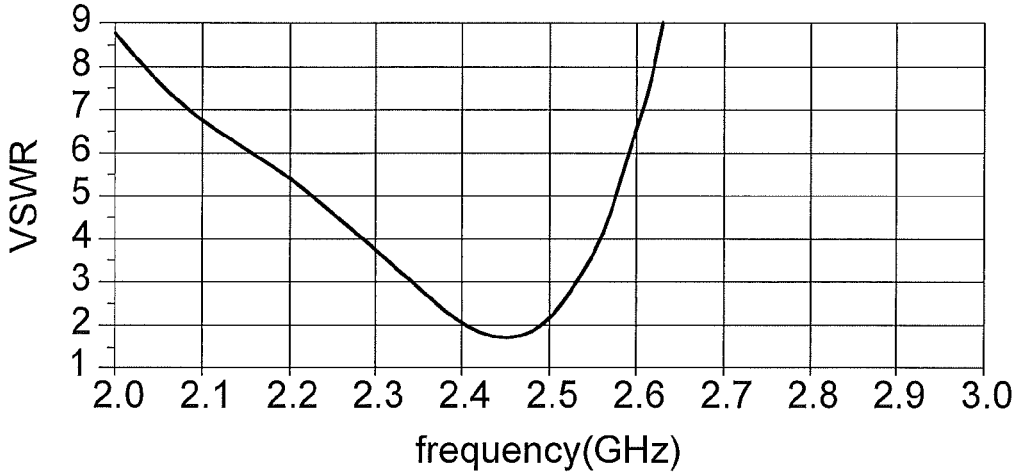
Figure 12:
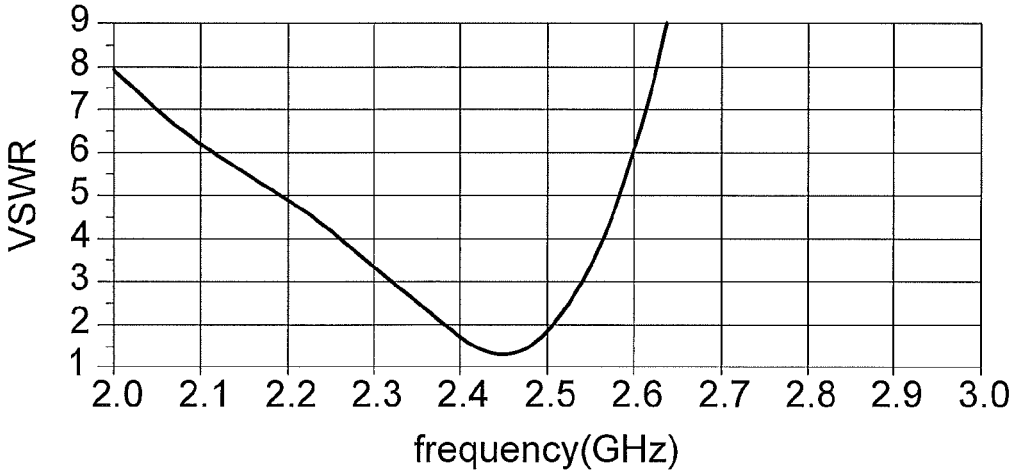

Referring to FIG. 10, FIG. 11 and FIG. 12, VSWR measurement charts of the planar antenna 23 with different dimension designs are respectively shown. FIG. 10 is a measurement chart of voltage standing wave ratio (VSWR) when the third interval L1=3.4, the first interval L2=6, the fourth interval H=6, the second interval g=0.4 and the fifth interval hs=1.6. FIG. 11 is a measurement chart of voltage standing wave ratio (VSWR) when the third interval L1=4.4, the first interval L2=6, the fourth interval H=6, the second interval g=0.4 and the fifth interval hs=1.6. FIG. 12 is a measurement chart of voltage standing wave ratio (VSWR) when the third interval L1=3.4, the first interval L2=7, the fourth interval H=6, the second interval g=1 and the fifth interval hs=1.6.

In the planar antenna, the second interval g, the fourth interval H and the fifth interval hs are determined by the ratio of the third interval L1 to the first interval L2. In FIG. 6 and FIG. 10, the ratio of the third interval L1 is the first interval L2 is equal to 3.4/6 for both the planar antenna 13 and the planar antenna 23. With the ratio of the third interval L1:the first interval L2 remaining unchanged, when the fourth interval H deceases, the planar antenna can be matched to 50 Ohm as required by the system by appropriately adjusting the size of the second interval g and the fifth interval hs. Likewise, in FIG. 7 and FIG. 11, the ratio of the third interval L1 to the first interval L2 is equal to 4.4/6 for both the planar antenna 13 and the planar antenna 23. With the ratio of the third interval L1:the first interval L2 remaining unchanged, when the second interval g changes, the planar antenna can be matched to 50 Ohm as required by the system by appropriately adjusting the size of the fifth interval hs. Likewise, in FIG. 8 and FIG. 12, the ratio of the third interval L1 to the first interval L2 is equal to 3.4/7 for both the planar antenna 13 and the planar antenna 23. With the ratio of the third interval L1:the first interval L2 remaining unchanged, when the second interval g changes, the planar antenna can be matched to 50 Ohm as required by the system by appropriately adjusting the size of the fifth interval hs. Thus, the planar antenna can be matched to system requirements through simple adjustments.

The wireless communication apparatus and the planar antenna thereof disclosed in above embodiments of the invention have many advantages exemplified below:

Firstly, area occupied by the planar antenna on a printed circuit board is reduced so as to meet the current requirement of size reduction of electronic devices;

Secondly, the difficulty in the circuit layout of a printed circuit board is reduced; and Thirdly, the planar antenna can be matched to system requirements through simple adjustments.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A planar antenna, comprising:

a radiation portion;

a shorting portion;

a feeding portion connected to the radiation portion and the shorting portion, wherein the radiation portion and the shorting portion are in a bent shape; and a grounding surface, comprising a first lateral side and a second lateral side, wherein the first lateral side is connected to the shorting portion and the first lateral side and the second lateral side are orthogonally connected to form a rectangular region, so that the radiation portion, the shorting portion and the feeding portion are distributed in the rectangular region, and the rectangular region comprises a first sub rectangular region and a second sub rectangular region not overlapping each other, the shorting portion is continuously bent so as to be distributed in the first sub rectangular region, and the radiation portion is continuously bent so as to be distributed in the second sub rectangular region;

wherein the radiation portion comprises:

a first bending being the bending of the radiation portion farthest away from the feeding portion, wherein the vertical distance, that is measured along a straight line that is perpendicular to both the first bending and the feeding portion, from the first bending to the feeding portion is a first interval; and a second bending being the bending of the radiation portion nearest to the feeding portion, wherein the vertical distance, that is measured along a straight line that is perpendicular to both the second bending and the feeding portion, from the second bending to the feeding portion is a second interval;

wherein the shorting portion comprises:

a first shorting end connected to the first lateral side of the grounding surface, the second lateral side of the grounding surface is adjacent to the radiation portion, the vertical distance, that is measured along a straight line that is perpendicular to both the first lateral side and the feeding portion, from the first lateral side to the feeding portion is equal to a third interval, the vertical distance, that is measured along a straight line that is perpendicular to both the first bending and the second lateral side, from the first bending to the second lateral side is equal to a fourth interval, the vertical distance, that is measured along a straight line that is perpendicular to both the first shorting end and the second lateral side, from the first shorting end to the second lateral side is equal to a fifth interval, and the second interval, the fourth interval and the fifth interval are determined by the ratio of the third interval to the first interval; and a second shorting end connected to one end of the feeding portion.

2. The planar antenna according to claim 1, wherein the rectangular region is smaller than 10 mm×8 mm.

3. The planar antenna according to claim 1, wherein the fourth interval is larger than or equal to the fifth interval.

4. The planar antenna according to claim 1, wherein the shorting portion is continuously bent to one end of the feeding portion from the first lateral side in a direction moving away from the first lateral side.

5. The planar antenna according to claim 1, wherein the radiation portion is continuously bent from one end of the feeding portion in a direction approaching the second lateral side.

6. The planar antenna according to claim 1, wherein the radiation portion, the shorting portion and the feeding portion are formed on a printed circuit board.

7. The planar antenna according to claim 1, wherein the feeding portion is located at the boundary between the first sub rectangular region and the second sub rectangular region.

8. A planar antenna, comprising:

a radiation portion comprising a first continuous bending; a first radiation end, and a second radiation end corresponding to the first radiation end, wherein the first continuous bending is located between the first radiation end and the second radiation end;

a shorting portion comprising a second continuous bending, a first shorting end, and a second shorting end corresponding to the first shorting end, wherein the second continuous bending is located between the first shorting end and the second shorting end;

a feeding portion comprising a first feeding end and a second feeding end corresponding to the first feeding end, wherein the first feeding end is connected to the feeding signal, and the second feeding end is connected to the first radiation end and the second shorting end, so that the radiation portion, the shorting portion and the feeding portion are distributed in a rectangular region; and a grounding surface, comprising a first lateral side and a second lateral side, wherein the first lateral side is orthogonally connected to the first shorting end and the first lateral side and the second lateral side are orthogonally connected to form a rectangular region, so that the radiation portion, the shorting portion and the feeding portion are distributed in the rectangular region, and the rectangular region comprises a first sub rectangular region and a second sub rectangular region not overlapping each other, the shorting portion is continuously bent so as to be distributed in the first sub rectangular region, and the radiation portion is continuously bent so as to be distributed in the second sub rectangular region;

wherein the largest vertical distance, that is measured along a straight line that is perpendicular to both the first continuous bending and the feeding portion, between the first continuous bending and the feeding portion is a first interval;

the shortest vertical distance, that is measured along a straight line that is perpendicular to both the first continuous bending and the feeding portion, between the first continuous bending and the feeding portion is a second interval; and the largest vertical distance, that is measured along a straight line that is perpendicular to the second continuous bending and the feeding portion, between the second continuous bending and the feeding portion is a third interval;

wherein the second lateral side and the first feeding end are adjacent to each other at an orthogonal angle, the vertical distance, that is measured along a straight line that is perpendicular to the second lateral side and a first bending extended from the first continuous bending, between the second lateral side and the first bending extended from the first continuous bending is equal to a fourth interval, the vertical distance, that is measured along a straight line that is perpendicular to the first shorting end and the second lateral side, between the first shorting end and the second lateral side is equal to a fifth interval, and the second interval, the fourth interval and the fifth interval are determined by a ratio of the third interval to the first interval.

9. The planar antenna according to claim 8, wherein the fourth interval is larger than or equal to the fifth interval.

10. A wireless communication apparatus, comprising:

a connecting port;

a printed circuit board connecting the connecting port;

a planar antenna formed on the printed circuit board, wherein the planar antenna comprises:

a radiation portion;

a shorting portion; and a feeding portion connected to the radiation portion and the shorting portion, wherein the radiation portion and the shorting portion are in a bent shape; and a grounding surface, comprising a first lateral side and a second lateral side, wherein the first lateral side is connected to the shorting portion and the first lateral side and the second lateral side are orthogonally connected to form a rectangular region so that the radiation portion, the shorting portion and the feeding portion are distributed in the rectangular region;

the rectangular region comprises a first sub rectangular region and a second sub rectangular region not overlapping each other, the shorting portion is continuously bent so as to be distributed in the first sub rectangular region, and the radiation portion is continuously bent so as to be distributed in the second sub rectangular region;

wherein the radiation portion comprises:

a first bending being the bending of the radiation portion farthest away from the feeding portion, wherein the vertical distance, that is measured along a straight line that is perpendicular to both the first bending to the feeding portion, from the first bending to the feeding portion is a first interval; and a second bending being the bending of the radiation portion nearest to the feeding portion, wherein the vertical distance, that is measured along a straight line that is perpendicular to both the second bending and the feeding portion, from the second bending to the feeding portion is a second interval, wherein the shorting portion comprises:

a first shorting end connected to the grounding surface, wherein the first lateral side is connected to the shorting portion, the second lateral side is adjacent to the radiation portion, the vertical distance, that is measured along a straight line that is perpendicular to both the first lateral side and the feeding portion, from the first lateral side to the feeding portion is equal to a third interval, the vertical distance, that is measured along a straight line that is perpendicular to both the first bending and the second lateral side, from the first bending to the second lateral side is equal to a fourth interval, the vertical distance, that is measured along a straight line that is perpendicular to both the first shorting end and the second lateral side, from the first shorting end to the second lateral side is equal to a fifth interval, and the second interval, the fourth interval and the fifth interval are determined by the ratio of the third interval to the first interval; and a second shorting end connected to one end of the feeding portion.

11. The wireless communication apparatus according to claim 10, wherein the fourth interval is larger than or equal to the fifth interval.

12. The wireless communication apparatus according to claim 10, wherein the shorting portion is continuously bent to one end of the feeding portion from the first lateral side in a direction moving away from the first lateral side.

13. The wireless communication apparatus according to claim 10, wherein the radiation portion is continuously bent from one end of the feeding portion in a direction approaching the second lateral side.

* * * * *